United States Patent [19]

Kanno et al.

[11] 4,076,402

[45] Feb. 28, 1978

[54] ELECTROPHOTOGRAPHIC APPARATUS WITH DETACHABLE PHOTOCONDUCTIVE DRUM

[75] Inventors: Tadaaki Kanno; Sunao Ikeda, both of Tokyo, Japan

[73] Assignee: Ricoh Company, Ltd., Tokyo, Japan

[21] Appl. No.: 653,879

[22] Filed: Jan. 30, 1976

[30] Foreign Application Priority Data

Jan. 31, 1975 Japan ..... 50-13566

[51] Int. Cl.[2] ..... G03G 15/00

[52] U.S. Cl. ..... 355/3 DR

[58] Field of Search ..... 355/3 R, 3 DR, 10, 16

[56] References Cited

U.S. PATENT DOCUMENTS

| | | | |
|---|---|---|---|
| 3,013,346 | 12/1961 | Crumrine et al. | 355/3 R X |
| 3,357,325 | 12/1967 | Eichorn et al. | 355/3 DR |
| 3,507,204 | 4/1970 | Kohler | 354/297 |
| 3,617,124 | 11/1971 | Haugen et al. | 355/16 |
| 3,689,146 | 9/1972 | Ito et al. | 355/3 DR X |
| 3,768,906 | 10/1973 | Michelson et al. | 355/100 X |
| 3,888,577 | 6/1975 | Meyer | 355/3 R |

*Primary Examiner*—Fred L. Braun

*Attorney, Agent, or Firm*—Frank J. Jordan

[57] ABSTRACT

A photoconductive drum is rotatably mounted on a shaft and is axially movable for removal from the apparatus. One or more guide rollers are disposed below and adjacent to one end of the drum so that a small axial movement of the drum will move the drum into supporting engagement with the guide rollers. The drum rolls over the guide rollers for easy removal from the apparatus. The guide rollers may also be movable so that the drum is moved into supporting engagement with the guide rollers and the drum and guide rollers are then removed from the apparatus in a unitary manner.

10 Claims, 8 Drawing Figures

ELECTROPHOTOGRAPHIC APPARATUS WITH DETACHABLE PHOTOCONDUCTIVE DRUM

The present invention relates to electrophotographic apparatus comprising a photoconductive drum and a guide roller assembly for supporting and axially guiding the drum for insertion into or removal from the apparatus.

In electrophotographic apparatus comprising a photoconductive drum, it is desirable that the drum be detachably mounted in the apparatus for purposes of replacement, cleaning, repair and the like. Various operative components of the apparatus are mounted around the periphery of the drum such as a charging unit, developing unit, sheet feeding unit, sheet separating unit and cleaning unit and a small clearance is generally provided between these units and the drum surface. It is quite difficult to insert the drum into or remove the drum from the apparatus without scraping the drum surface against the various units since the drum is heavy and must be held in the manner of a cantilever beam for insertion and removal. The drum is mounted on a shaft which must be supported at one end or the other for insertion or removal of the drum. This cantilever type of support imposes a high bending moment on the shaft which may cause the same to bend, which will result in improper rotation of the drum.

It is therefore an object of the present invention to provide electrophotographic apparatus comprising a detachable photoconductive drum and a roller assembly for guidingly supporting the drum during axial movement thereof for insertion or removal.

It is another object of the present invention to provide means for preventing scratching of a photoconductive drum on various components of an electrophotographic apparatus and bending of a shaft on which the drum is mounted during insertion or removal of the drum.

The above and other objects, features and advantages of the present invention will become more clear from the following detailed description taken with the accompanying drawings, in which.

Figure 1:
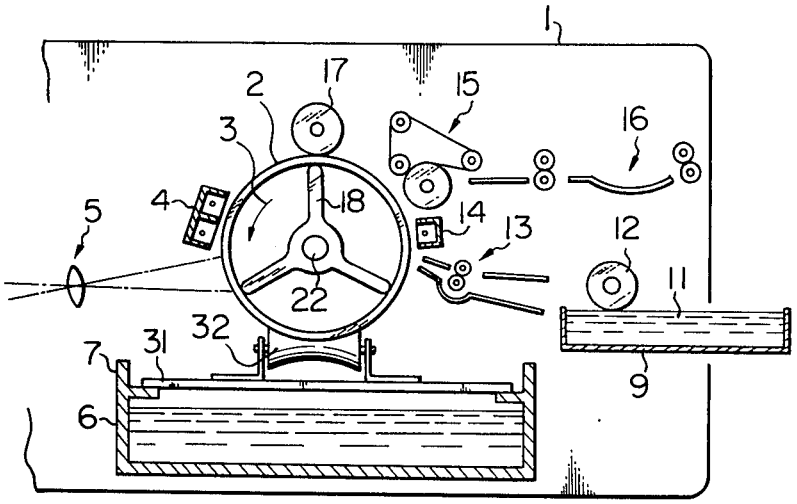
FIG. 1 is an elevation of a first embodiment of electrophotographic apparatus of the present invention.
Figure 2:
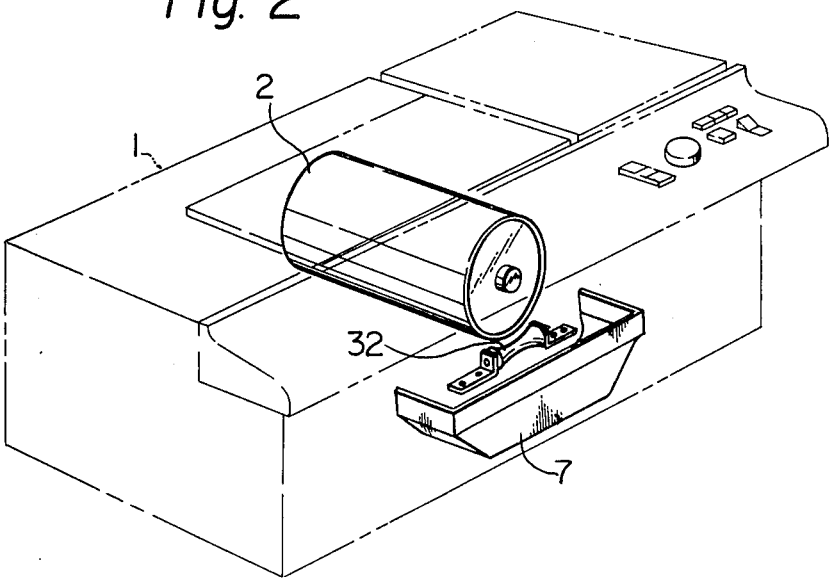
FIG. 2 is a perspective view of the apparatus shown in FIG. 1.

Referring now to FIG. 1, a photoconductive drum 2 mounted in an electrophotographic copying apparatus housing 1 is rotatable in the direction shown by an arrow 3, and a photoconductive layer (no numeral) formed on the outer periphery of the drum 2 is uniformly charged by a charger 4 and imaged by an optical system 5, thus forming on the drum 2 an electrostatic latent image corresponding to an original document (not shown). This electrostatic latent image is developed to produce a toner image by a liquid developer 6 from a developer tank 7. Sheets 11 of copying paper accomodated in a paper supply rack 9 are fed into contact with the drum 2 periphery by a paper feed roller 12 and a guide mechanism 13, and the toner image is transferred by a transfer charger 14 onto one of the sheets 11 pressed against the drum 2 periphery. After the toner image has been transferred to the sheet 11, the sheet 11 is separated from the drum 2 periphery by a separation mechanism 15, and is then fed to the outside of the apparatus housing 1 by a sheet discharging mechanism 16. The residual image on the drum 2 periphery is removed by a cleaning unit 17.

Figure 3:
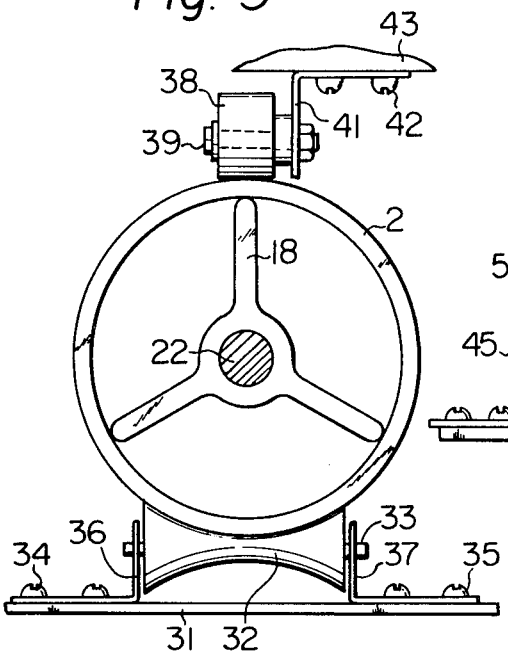
FIG. 3 is an enlarged elevation of a guide roller assembly of the apparatus shown in FIG. 1.
Figure 5:
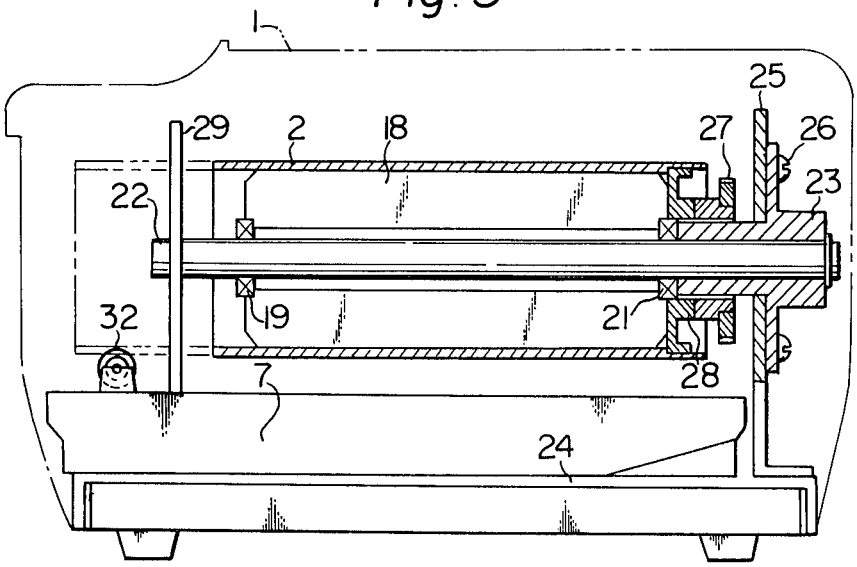
FIG. 5 is a longitudinal section of the apparatus shown in FIG. 1.

In FIG. 5, the photoconductive drum 2 has its inner periphery axially slidably mounted on a supporting member 18, which in turn is rotatably mounted on a shaft 22 through the intermediary of bearings 19 and 21. The shaft 22 has one end (the right end in the Figure) held by a mount 23 which in turn is secured by screws 26 to a fixed member 25 having its base portion secured to a base plate 24. A driven gear 27 is connected to a driving unit which is not shown, and a gear 28 which is integral with the driven gear 27 transmits its rotation to the photoconductive drum 2. The other end (the left end in the Figure) of the shaft 22 is held by a mounting plate 29 whose base portion is attached to a supporting plate 31 (see FIG. 1) whose ends are secured to the side walls of the developer tank 7. A guide roller 32 is arranged adjacent to one end of the photoconductive drum 2 (the left end in FIG. 5). As shown in FIG. 3, the guide roller 32 has an hourglass shape and is mounted on a shaft 33 which has its ends rotatably mounted in supporting members 36 and 37 which in turn are secured to the supporting plate 31 with screws 34 and 35. A guide roller 38 which is arranged above the roller 32 is mounted on a supporting member 41 by a shaft 39, and the supporting member 41 is secured to a fixed member 43 with screws 42.

Figure 4:
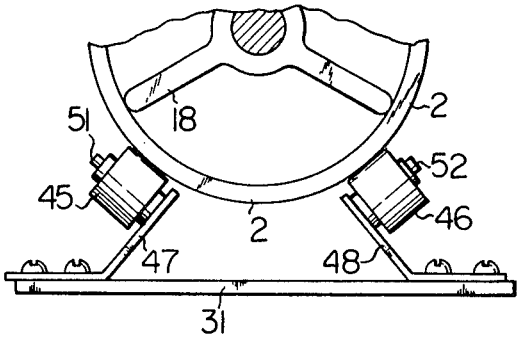
FIG. 4 is a fragmentary elevation showing an alternative guide roller assembly.

When the mounting plate 29 is removed and the photoconductive drum 2 is slid on the shaft 22 and pulled out axially in the direction shown in phantom line in FIG. 5 to remove the photoconductive drum 2, the drum 2 is guided with the lower outer periphery of the drum 2 being supported by the roller 32, with the result that the drum 2 can be easily inserted into or removed from the copying apparatus housing 1. Moreover, no bending moment is imposed on the shaft 22 during these operations. The present invention is not necessarily limited to the use of a single guide roller 32, and it is possible to use, for example, independent guide rollers 45 and 46 as shown in FIG. 4. The guide rollers 45 and 46 are equally spaced from the lowest portion of the drum 2 in a direction perpendicular thereto, and are respectively mounted by shafts 51 and 52 on supporting members 47 and 48 which in turn are secured to the supporting plate 31. It is also possible to arrange the supporting members 47 and 48 so that they may be axially slid in a unitary manner with the drum 2 after the lower outer periphery of the photoconductive drum 2 has been supported thereon. Irrespective of the type of guide rollers used, by using an elastic material such as rubber for the part of the guide rollers which comes into direct contact with the drum 2 periphery, it is possible to prevent any damage to the periphery of the photoconductive drum 2.

Figure 6:
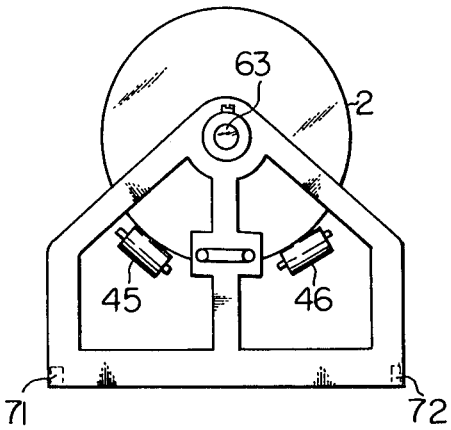
FIG. 6 is a schematic elevation of a second embodiment of the present invention.
Figure 8:
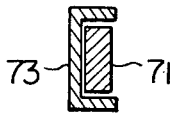
FIG. 8 is an enlarged view of guide means of the apparatus shown in FIG. 6.
Figure 7:
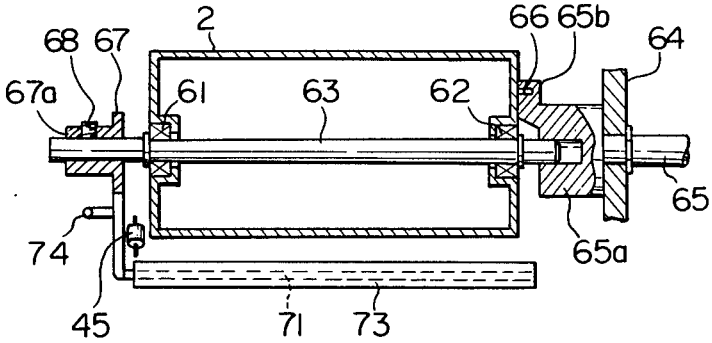
FIG. 7 is a longitudinal section of the apparatus shown in FIG. 6.

While, in the embodiment described above, when sliding the photoconductive drum 2, the drum 2 is axially guided while being supported by the rotary member 18, this function may be performed by other means such as shown in FIGS. 6 and 7. The photoconductive drum 2 is rotatably mounted on a shaft 63 through the intermediary of bearings 61 and 62, and the right end (in FIG. 7) of the shaft 63 is detachably mounted in a flange 65*a* of a shaft 65 which in turn is rotatably mounted on a fixed member 64. The shaft 65 is driven by a driving unit which is not shown, and an engaging portion 65*b* of the flange 65*a* is adapted to engage with a projection 66 fixedly mounted on the right end of the photoconductive drum 2 to thereby transmit the rotation of the shaft 65 to the photoconductive drum 2. The left end of the shaft 63 is secured by a setscrew 68 to a boss 67*a* which is mounted on the upper portion of supporting plate 67. Guide bars 71 and 72 are respectively secured to the edges of the supporting plate 67. As shown in FIG. 8, the guide bars 71 and 72 are slidably mounted in channel shaped rails 73 (only one is shown) which are fixed to the housing 1. To remove the photoconductive drum 2 from the housing 1, a handle 74 which is fixedly mounted on the supporting plate 67 is pulled leftward in FIG. 7 so that the photoconductive drum 2 is guided with its lower outer periphery being supported by the guide rollers 45 and 46. In this embodiment, the drum 2 is not axially slidable on the shaft 63, and the shaft 63 and drum 2 are removed from the housings in a unitary manner. Guiding of the drum 2 during its movement is effected by the associated operation of the sliding bars 71 and 72 and the rails 73.

In accordance with the present invention, when inserting or removing the photoconductive drum 2, the lower outer periphery of the drum 2 is supported by the guide roller or rollers, and in this way the photoconductive drum 2 can be easily inserted into or removed from the copying apparatus housing 1. At the same time, the application of a large load on the shaft of the photoconductive drum 2 can be prevented.

What is claimed is:

1. Electrophotographic apparatus comprising:

a housing;

a photoconductive drum having a rotary axis and rotatably mounted in the housing in an operative position, the photoconductive drum being detachable from the housing through movement in its axial direction from the operative position; and a roller assembly mounted below and axially spaced from the photoconductive drum when the photoconductive drum is in the operation position, the roller assembly comprising at least one roller having a rotary axis perpendicular to the rotary axis of the photoconductive drum, the photoconductive drum engaging with and being guidingly supported by the roller assembly at positions which are equally spaced from a lowest portion of the photoconductive drum when moved axially for detachment from the housing.

2. The apparatus of claim 1, in which the roller assembly comprises an hourglass shaped roller.

3. The apparatus of claim 1, in which the roller assembly comprises two rollers which are equally spaced from the lowest portion of the photoconductive drum in a direction perpendicular to the axial direction of the photoconductive drum.

4. The apparatus of claim 1, further comprising a guide roller assembly mounted above and axially spaced from the photoconductive drum when the photoconductive drum is in the operative position, the photoconductive drum engaging with and being guided by the guide assembly when moved axially for detachment from the housing.

5. The apparatus of claim 1, in which the roller assembly is movable in the axial direction of the photoconductive drum.

6. The apparatus of claim 1, further comprising a shaft supported by the housing, the photoconductive drum being supported for rotation by the shaft.

7. The apparatus of claim 6, in which the shaft is fixedly supported by the housing and the photoconductive drum is rotatably mounted on the shaft.

8. The apparatus of claim 6, in which the photoconductive drum is axially slidably mounted on the shaft and the shaft is axially supported by the housing, the photoconductive drum sliding on the shaft for detachment from the housing.

9. The apparatus of claim 6, in which the photoconductive drum is axially fixedly mounted on the shaft, the photoconductive drum and the shaft being axially movable in a unitary manner for detachment from the housing.

10. The apparatus of claim 9, further comprising a support member for fixedly supporting an end of the shaft adjacent to the roller assembly and guide means for guidingly and movably mounting the support member to the housing so that the support member is movable in the axial direction of the photoconductive drum.

* * * * *